US007234170B2

(12) United States Patent
Simic

(10) Patent No.: US 7,234,170 B2
(45) Date of Patent: Jun. 26, 2007

(54) HEAT/COLD RESISTANT PROTECTIVE HAND COVERING

(75) Inventor: Milan Simic, Montreuil (FR)

(73) Assignee: Quadion Corporation, Minneapolis, MN (US)

( * ) Notice: Subject to any disclaimer, the term of this patent is extended or adjusted under 35 U.S.C. 154(b) by 311 days.

(21) Appl. No.: 10/980,378

(22) Filed: Nov. 2, 2004

(65) Prior Publication Data

US 2005/0177923 A1 Aug. 18, 2005

Related U.S. Application Data

(60) Provisional application No. 60/545,027, filed on Feb. 17, 2004.

(51) Int. Cl.
*A41D 13/08* (2006.01)

(52) U.S. Cl. ..... 2/16; 2/161.6

(58) Field of Classification Search ..... 2/16, 2/20, 161.6, 158; 15/227; D29/119
See application file for complete search history.

(56) References Cited

U.S. PATENT DOCUMENTS

| | | | | |
|---|---|---|---|---|
| 61,841 | A | 2/1867 | Lewis | |
| 919,406 | A | 4/1909 | Warren | |
| 1,279,855 | A * | 9/1918 | Garvey | 2/168 |
| 1,559,114 | A | 10/1925 | Maranville | |
| 1,990,553 | A | 2/1935 | Hirsch et al. | |
| 2,187,430 | A | 1/1940 | Olmsted et al. | |
| 2,229,837 | A | 1/1941 | Claffy | |
| 2,335,871 | A | 12/1943 | Milligan | |
| 2,451,758 | A | 10/1948 | Malm | |
| 2,581,249 | A | 1/1952 | Ganz | |
| D183,522 | S | 9/1958 | Jackman | |
| 2,889,556 | A | 6/1959 | Mehler | |
| D188,035 | S | 5/1960 | Mackay | |
| 3,148,235 | A | 9/1964 | Velonis et al. | |
| 3,235,881 | A * | 2/1966 | Chisholm | 2/167 |
| 3,602,917 | A | 9/1971 | Seunevel et al. | |
| 3,872,515 | A | 3/1975 | Miner et al. | |
| 3,883,899 | A | 5/1975 | Ganz | |
| 3,918,096 | A | 11/1975 | Lim | |

(Continued)

FOREIGN PATENT DOCUMENTS

| | | |
|---|---|---|
| CN | 2127297 Y | 2/1993 |

(Continued)

OTHER PUBLICATIONS

Tops Plastiques: Premiere!, Le Magazine Des Plastiques—Entree en Matieres, vol. No. 16, Jun. 1999, p. 6, Service Communication Le Diamant A, Paris.

*Primary Examiner*—Katherine Moran
(74) *Attorney, Agent, or Firm*—Schroeder & Siegfried, P.A.

(57) ABSTRACT

An ambidextrous protective hand covering monolithically formed from a heat/cold resistant flexible silicone material, the opposing interior and exterior surfaces of which each include a plurality of integrally-formed raised nodules that are positionally off-set relative to one another with non-aligning transverse axes. The positionally off-set exterior and interior nodules act to oppose thermal conductivity and provide an effective thermal barrier so as to protect the hand and wrist during handling of articles of differing or uncomfortable temperatures. Optionally, the formulation of the heat/cold resistant material may be chemically enhanced to provide a thermal luminescent change in color of the hand protective covering upon detection of excessive hot/cold temperatures.

39 Claims, 3 Drawing Sheets

U.S. PATENT DOCUMENTS

| | | | | | |
|---|---|---|---|---|---|
| 4,000,903 | A | | 1/1977 | Swanson | |
| 4,061,709 | A | | 12/1977 | Miller et al. | |
| 4,084,265 | A | * | 4/1978 | Anfelt | 2/163 |
| 4,218,778 | A | | 8/1980 | Stansbury | |
| 4,308,762 | A | | 1/1982 | Jannard | |
| D268,222 | S | | 3/1983 | Chen | |
| 4,400,831 | A | | 8/1983 | Rietz | |
| 4,411,026 | A | | 10/1983 | Secter | |
| 4,454,611 | A | | 6/1984 | Tschirch et al. | |
| 4,570,269 | A | | 2/1986 | Berlese | |
| 4,603,439 | A | | 8/1986 | Golomb | |
| 4,628,544 | A | * | 12/1986 | Erickson | 2/158 |
| 4,660,228 | A | | 4/1987 | Ogawa et al. | |
| 4,682,803 | A | * | 7/1987 | Andrews | 452/196 |
| 4,751,747 | A | | 6/1988 | Banks et al. | |
| 4,845,781 | A | | 7/1989 | Strickland et al. | |
| 4,847,918 | A | | 7/1989 | Sturm | |
| 4,916,757 | A | | 4/1990 | Berlin et al. | |
| 4,942,626 | A | | 7/1990 | Stern | |
| 5,020,160 | A | | 6/1991 | Cano | |
| 5,070,540 | A | | 12/1991 | Bettcher et al. | |
| 5,075,899 | A | | 12/1991 | Funahashi et al. | |
| D323,217 | S | | 1/1992 | Holden | |
| 5,134,746 | A | | 8/1992 | William | |
| 5,173,966 | A | | 12/1992 | DeLeo | |
| 5,304,337 | A | | 4/1994 | Chen et al. | |
| 5,323,490 | A | | 6/1994 | Yarbrough | |
| 5,361,415 | A | | 11/1994 | Deering et al. | |
| 5,452,478 | A | | 9/1995 | Rombach et al. | |
| 5,500,956 | A | | 3/1996 | Schulkin et al. | |
| 5,500,957 | A | | 3/1996 | Stein | |
| 5,566,394 | A | | 10/1996 | Flick | |
| 5,572,739 | A | | 11/1996 | Kolada et al. | |
| 5,579,539 | A | | 12/1996 | Flick | |
| 5,598,582 | A | | 2/1997 | Andrews et al. | |
| 5,625,900 | A | * | 5/1997 | Hayes | 2/161.8 |
| 5,636,645 | A | | 6/1997 | Ou | |
| 5,641,316 | A | | 6/1997 | Bakalis | |
| 5,676,092 | A | | 10/1997 | Ortolivo | |
| 5,717,994 | A | | 2/1998 | Goldsmith | |
| 5,794,266 | A | * | 8/1998 | Han | 2/159 |
| 5,807,296 | A | | 9/1998 | Stubbs | |
| 5,862,916 | A | | 1/1999 | Utecht | |
| 5,907,870 | A | | 6/1999 | Monroe et al. | |
| 5,953,756 | A | | 9/1999 | Vrissimdjis | |
| 5,991,926 | A | | 11/1999 | Lakusiewicz | |
| RE36,778 | E | * | 7/2000 | DeLeo | 2/161.7 |
| 6,081,928 | A | | 7/2000 | Bourne | |
| 6,092,238 | A | | 7/2000 | Fierabend, Jr. | |
| 6,199,211 | B1 | | 3/2001 | Franzolino | |
| 6,203,080 | B1 | | 3/2001 | Surplus | |
| D441,509 | S | | 5/2001 | Lion et al. | |
| 6,298,488 | B1 | | 10/2001 | Duncan et al. | |
| 6,305,023 | B1 | | 10/2001 | Barkes | |
| 6,374,417 | B1 | | 4/2002 | Stagnitta | |
| 6,427,249 | B1 | | 8/2002 | Mattesky | |
| D470,980 | S | | 2/2003 | Bignon et al. | |
| 6,532,597 | B2 | * | 3/2003 | Bignon et al. | 2/161.6 |
| D477,690 | S | | 7/2003 | Howell et al. | |
| 6,658,668 | B2 | | 12/2003 | Newcomb | |
| D488,887 | S | | 4/2004 | Bignon et al. | |
| D490,189 | S | | 5/2004 | Bignon et al. | |
| D491,317 | S | | 6/2004 | Bignon et al. | |
| 7,117,536 | B2 | * | 10/2006 | Burnett et al. | 2/16 |
| 2002/0010957 | A1 | | 1/2002 | Katz | |
| 2003/0126669 | A1 | | 7/2003 | Bignon et al. | |
| 2006/0048270 | A1 | * | 3/2006 | Chen | 2/167 |

FOREIGN PATENT DOCUMENTS

| | | |
|---|---|---|
| DE | 19837247 | 7/1999 |
| JP | 07-082603 | 3/1995 |
| WO | WO90/13232 | 11/1990 |

* cited by examiner

HEAT/COLD RESISTANT PROTECTIVE HAND COVERING

CROSS REFERENCE TO RELATED APPLICATIONS

This is an application for a patent which is also disclosed in Provisional Application Ser. No. 60/545,027, filed on Feb. 17, 2004 by the same inventor, namely Milan Simic, and entitled "HEAT/COLD RESISTANT PROTECTIVE HAND COVERING," the benefit of the filing date of which is hereby claimed.

BACKGROUND OF THE INVENTION

Protective hand coverings designed to withstand uncomfortable temperatures, aggressive chemicals and the like, have been in existence for many years and find common use in many household and industrial applications. Such conventional hand coverings have existed in many forms, including gloves, mittens, pads and other protective coverings, and are generally manufactured from one or more of a number of materials, such as natural or synthetic fabrics, leather, rubber and other plastic materials. While such conventional hand coverings have been moderately successful in providing the desired protection, due to construction and materials used, all such devices have had limited effectiveness in adequately protecting the hand while offering suitable comfort and wearability.

In more recent times, efforts have been directed toward the manufacture of protective hand coverings made of silicone rubber which, due to the material's inherent characteristics, provides improved wearability and fitness, strength, and resistance to hot and cold temperatures, as well as aggressive chemicals. One example of such a hand covering formed of silicone rubber can be found in U.S. Pat. No. 6,532,597. As shown, hand coverings of this type are usually formed of a somewhat thicker material for added protection against extreme conditions, and are typically designed with a smooth surface contacting the palm of the hand, such that the protective material rests flat against the hand when grasping a desired article.

Under such circumstances, the silicone material of the protective covering acts as the sole barrier (thermal or otherwise) for protection of the hand against the encountered elements. While effective, the thickness of the material often tends to make the hand covering more cumbersome to wear and manipulate, and more costly to manufacture. Moreover, the smooth surface contacting the hand provides little ventilation, and the material's inability to breathe effectively can lead to discomfort of the hand as a result of perspiration, clamminess and the like.

It is therefore evident that there is a need for a protective hand covering which not only provides the desired strength and resistance against extreme elements, but is also supple and comfortable to wear under any condition, can be manufactured in a simple and cost effective manner, and provides adequate ventilation for the hand during use thereof.

BRIEF SUMMARY OF THE INVENTION

The present invention is related generally to the art of protective hand coverings, and particularly to an improved heat/cold-resistant hand covering that incorporates a unique nodular design that significantly opposes thermal conductivity and provides an effective thermal barrier between the exposed hand and articles of differing or uncomfortable temperatures. Since the hand covering can be readily formed monolithically from silicone rubber, it simplifies and limits the required manufacturing procedures, as well as the associated costs thereof.

In the preferred embodiment of my invention, the protective hand covering is designed in the form of an ambidextrous mitten, wherein both the exterior and interior surfaces of the mitten are formed with a plurality of raised nodules that function to form an effective thermal barrier between the hand and the article of differing or uncomfortable temperature being engaged therewith. The raised nodules are constructed to have a generally low profile arcuate configuration, and are preferably spread relatively evenly and continuously in spaced relation over the major portion of both the exterior and interior surfaces of the mitten. While the preferred embodiment is shown and described herein in the form of a mitten, it is certainly conceivable that this nodular technology could be readily applied in the design of a heat/cold resistant protective glove, as well as a hot pad.

Importantly, the exterior and interior nodules formed on the mitten are specifically designed to be positionally off-set in non-aligning relation relative to one another. In other words, location of the nodules are such that the central transverse axis of each exterior nodule extending through its arc will not align with a similar transverse axis of an interior nodule. As a result of this unique nodular configuration, heat and/or cold that is absorbed and transferred through the exterior nodules is not transferred directly to the hand. Rather, it meets an insulating barrier of air on the interior of the glove, and must be diverted laterally through adjacent interior nodules before entering the hand.

By utilizing this unique nodular design, an article being grasped with the mitten comes primarily only in contact with the outermost crest portion of the arcuately-shaped exterior nodules, thereby preventing substantial engagement with the underlying exterior surface of the mitten. Similarly, on the interior of the mitten, the exposed hand engages primarily only the outermost crest portion of the arcuately-shaped interior nodules, thereby preventing the hand from directly or substantially engaging the underlying interior surface of the mitten. As a result of the decreased surface area engaging the article of differing or uncomfortable temperature, and the insulating air pockets formed by the positionally off-set interior nodules, an effective thermal barrier is provided which opposes thermal conductivity therethrough and facilitates ventilation of the hand.

The material used in the manufacture of my protective hand covering should have good heat resistant properties with good elongation and flexibility characteristics. The preferred material is silicone (polydimethylsiloxane), which is available in various forms, including Liquid Silicone Rubber (LSR) and High Consistency Rubber (HCR). The preferred range of hardness of the silicone material is 20-50 Shore A; however, a broader range of approximately 5-80 Shore A would also be considered suitable for manufacture. With the use of such material, my protective hand covering may be manufactured as a monolithic one-piece unit utilizing any of the compression, injection, or transfer molding processes that are well-known in the art.

As an added desirable feature, the material utilized in the manufacture of my protective hand covering may be chemically enhanced with a thermoluminescent chemical additive that is sensitive to temperature. The chemical additive senses when the protective hand covering exceeds a threshold temperature and alerts the user of the potentially dangerous temperatures by causing the hand covering to change color.

Utilizing the above construction and materials presents numerous benefits in addition to its superior protection against hot and cold temperatures. As will become more apparent hereafter, my improved protective hand covering may be manufactured as a low cost one-piece moldable unit that is environmentally and medically safe, liquid impervious, dishwasher-safe, and heat/freeze resistant from at least −60° C. to 300° C. It is relatively soft, flexible and comfortable to wear, yet durable and aesthetically pleasing to the eye.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1:
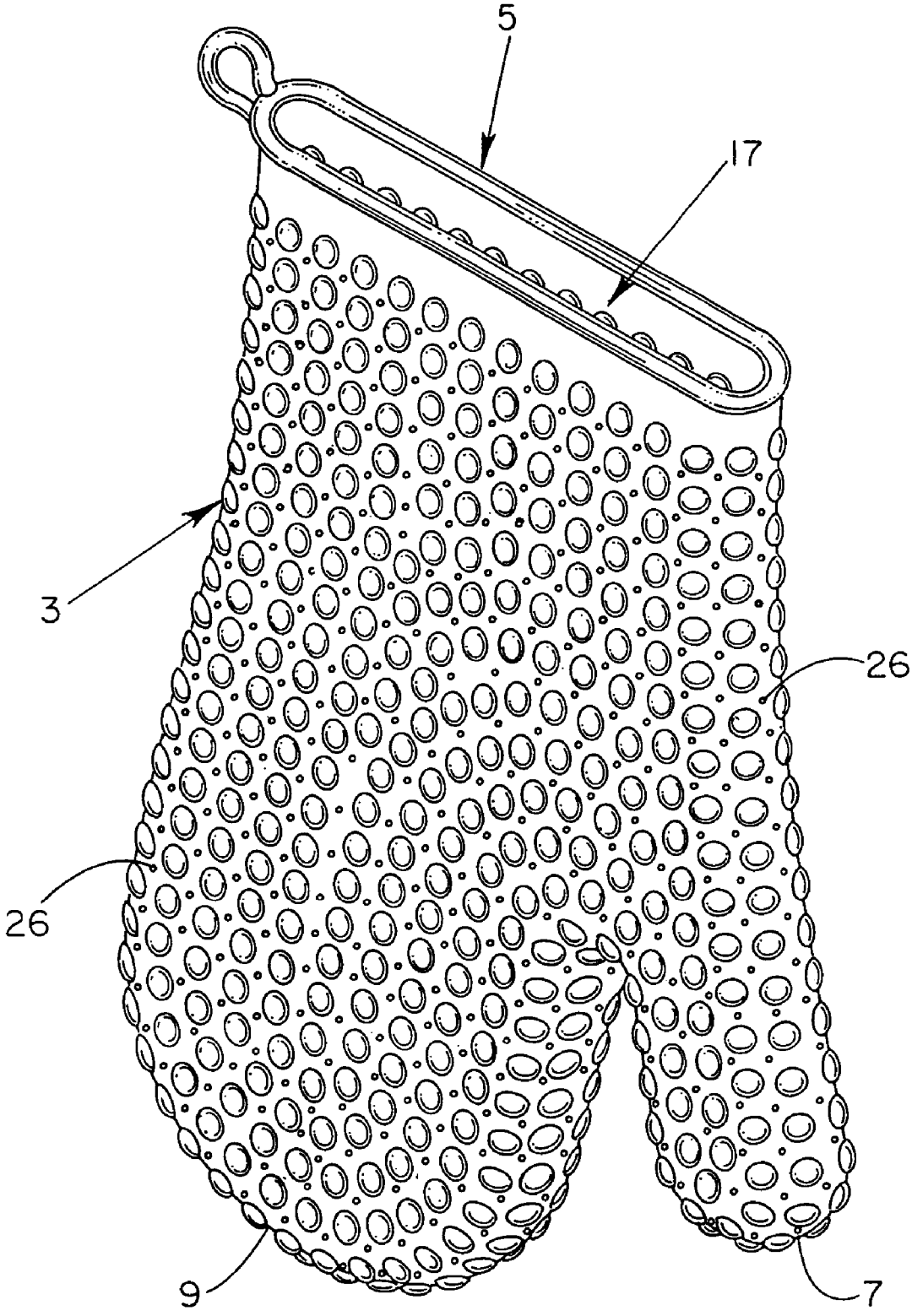
FIG. 1 is a perspective view of a heat/cold resistant protective hand covering incorporating the nodular technology that forms the basis of my invention herein.

As shown in FIG. 1, my invention, in its preferred form, includes a heat/cold resistant protective hand covering in the form of a mitten 1 which incorporates my unique nodular technology that opposes thermal conductivity. As seen therein, the mitten 1 is manufactured as a monolithic one-piece unit having opposite sides or panels 3 and 5 that are constructed generally symmetrical to facilitate ambidextrous use thereof. Mitten 1 includes a thumb section 7 and an enlarged section 9 which covers the remaining fingers of the hand. Although the preferred mode of my invention is shown in the form of a mitten, it will be appreciated that the nodular technology which forms the basis of my invention could readily be incorporated into a heat/cold resistant protective glove, or even into a hot pad.

Figure 2:
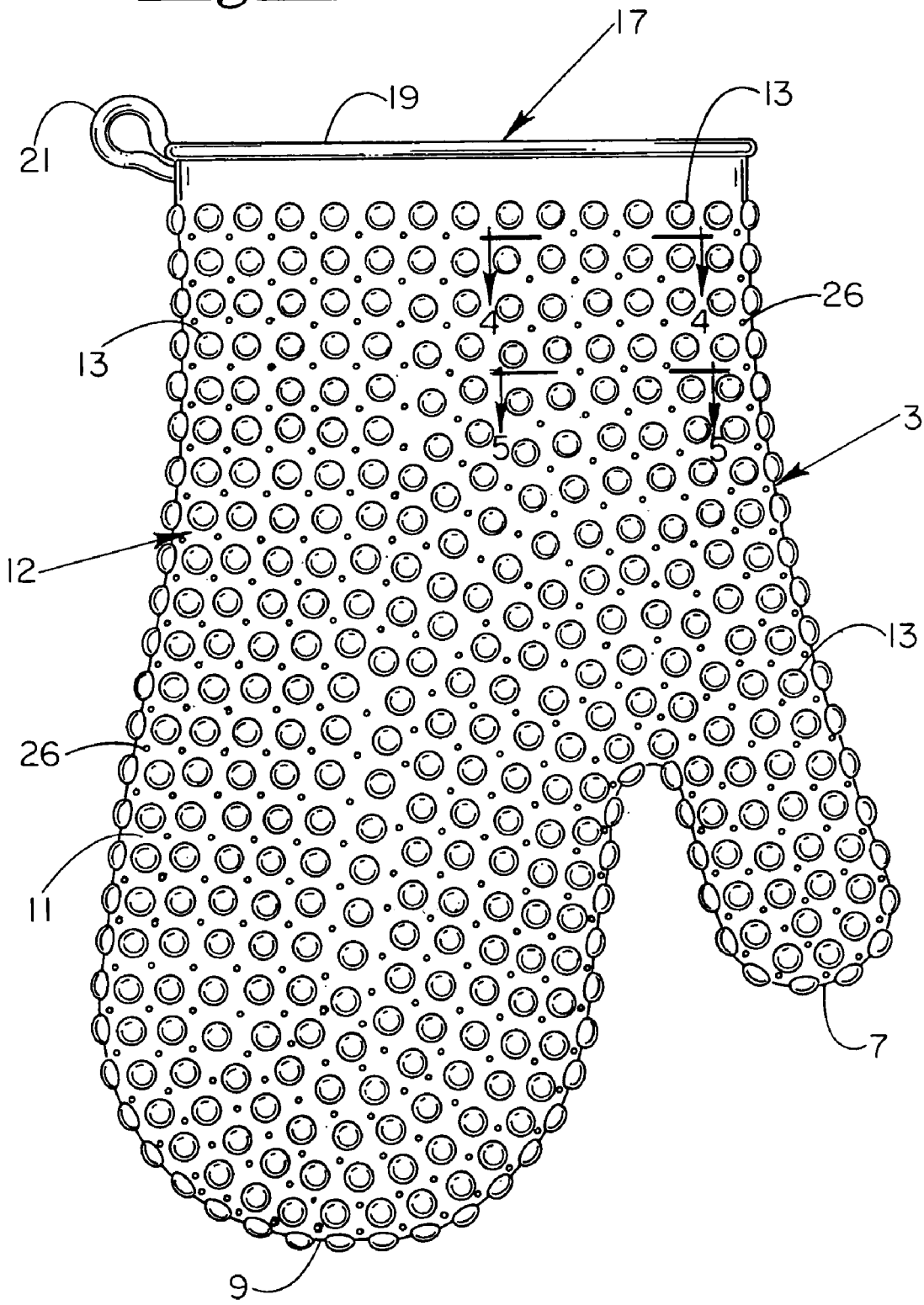
FIG. 2 is a side elevational view of the protective hand covering shown in FIG. 1, showing the exterior surface thereof having a plurality of raised nodules formed therein.
Figure 3:
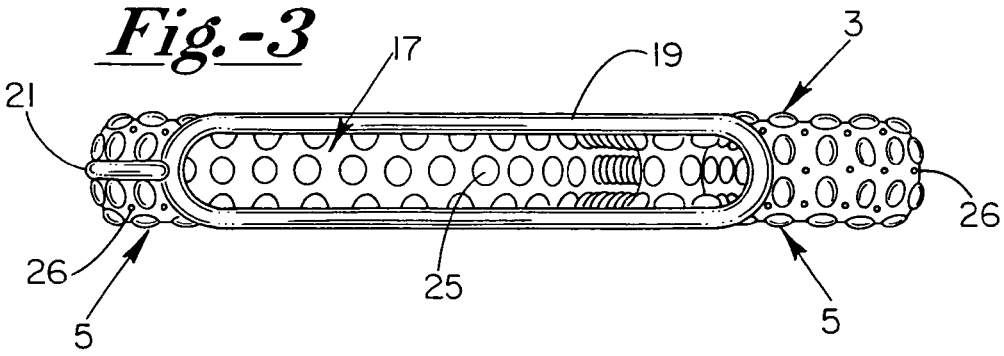
FIG. 3 is a bottom plan view of the protective hand covering shown in FIG. 1, showing the opening to the interior thereof.
Figure 4:
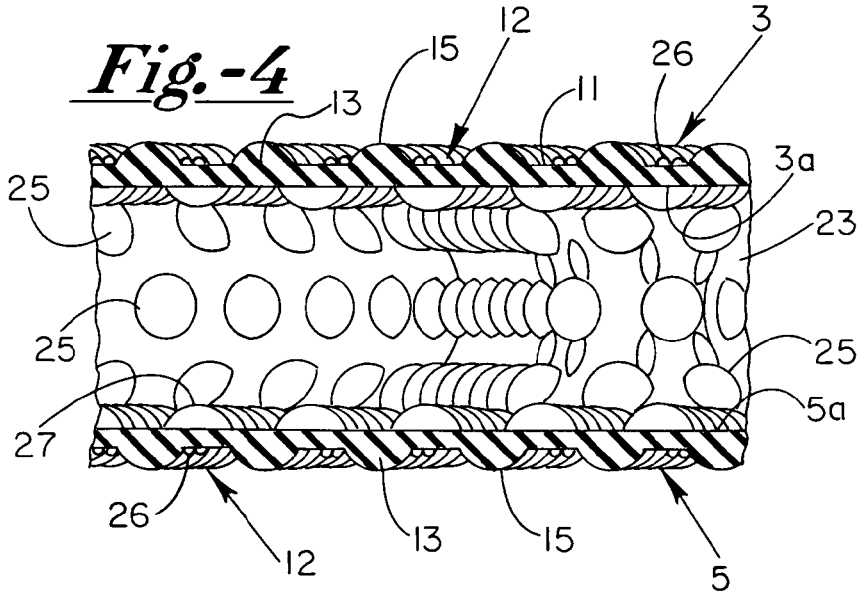
FIG. 4 is an enlarged portion of a cross sectional view taken along line 4-4 of FIG. 2, showing the off-set alignment of the exterior and interior nodules of the protective hand covering shown therein.

With reference to FIGS. 2 and 3, it can be seen that substantially the entire exterior surface 11 of mitten 1, composed generally of opposite sides 3 and 5, is constructed with a plurality of integrally-formed raised nodules 13 extending outwardly therefrom. Exterior nodules 13 are positioned about the exterior surface 11 in relatively uniformly-spaced relation, thereby creating a generally continuous and open area or channel 12 extending around and between the various nodules where air can freely flow. As best seen in FIG. 4, nodules 13 are preferably generally arcuate in cross section, which provides desirable strength and integrity to the nodules, and minimizes the contact surface area or crest 15 that is intended to primarily engage the article being handled.

As further shown in FIG. 2, in the preferred embodiment, nodules 13 cover the exterior surface 11 around all sides and edges of the mitten 1, and extend to an area just short of opening 17 to the interior of mitten 1. A supporting rib 19 extends around and defines opening 17 to the interior of mitten 1, and a hook element 21 is integrally formed therewith to provide means for hanging mitten 1 for storage, if so desired.

Figure 5:
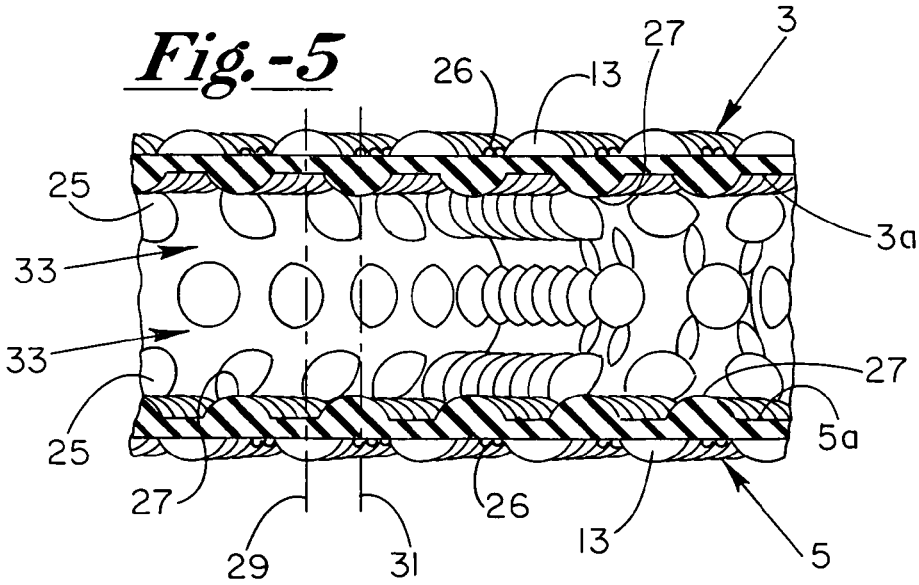
FIG. 5 is an enlarged portion of the cross sectional view taken along line 5-5 of FIG. 2, also showing the relative positioning and off-set alignment of the interior nodules relative to the exterior nodules of the protective hand covering shown in FIG. 2.

As can be seen best in FIGS. 3, 4 and 5, the interior surface 23 of mitten 1, including inner sides 3*a* and 5*a* thereof, is also constructed with a plurality of integrally formed raised interior nodules 25 that are relatively uniformly spaced thereabout and extend outwardly therefrom toward the interior of the mitten. Similar to the exterior nodules 13, interior nodules 25 are preferably constructed with an arcuate cross-sectional configuration to provide strength and integrity thereto, and to minimize the contact surface area or crest 27 which primarily engages the hand extending therewithin. While nodules 13 and 25 are configured as semi-spherical in shape in the preferred embodiment, it is certainly conceivable that they may take on other protruding-type configurations without departing from the invention herein.

As shown best in reference to FIG. 5, most importantly, the exterior nodules 13 are positionally off-set in non-aligning relation relative to the location of interior nodules 25, such that the central transverse axes 29 and 31, respectively, of each of the exterior and interior nodules 13 and 25, extend in separate planes. By constructing mitten 1 in this manner, with the exterior nodules 13 positionally off-set from the interior nodules 25, a thermal barrier is effectively created which acts to limit or oppose thermal conductivity from the external source of differing temperature through mitten 1 to the hand. As heat or cold is transferred through the exterior nodules 13 toward the interior of mitten 1, a substantial portion of the heat/cold transfer is caused to enter the air pockets 33 between the interior nodules 25, and given that air functions as an excellent insulator, the transfer of heat/cold to the hand is significantly limited. In fact, through experimentation, it has been shown that an article of 200-250° C. is capable of being held using my improved heat-resistant protective mitten 1 for at least five (5) minutes without developing any burning sensation.

As can be seen throughout FIGS. 1-5 of the appended drawings, the exterior surface 11 of the mitten 1 may also carry a plurality of smaller teats 26 interspersed between the exterior nodules 13. These smaller teats 26 function not only to locate the position of the interior nodules 25, but also function to inform the user of the mitten 1 of their existence so as to reassure the user that the entire surface of the mitten 1 acts as a protectant against potentially dangerous temperatures. Moreover, these teats 26 act to increase the surface of radiation, which facilitates faster cooling of the mitten 1, thereby increasing protection of the hand. Finally, such teats 26 also add to the aesthetic appeal of the mitten 1.

In use, an exposed hand (not shown) may be inserted through opening 17 of mitten 1 and into the interior thereof, where interior nodules 25 will bear against a substantial portion of the hand and create an insulating air barrier in pocket 33 that provides excellent ventilation and an effective heat/cold barrier between the hand and the interior surface 23 of the mitten 1. Because nodules 25 are formed of an arcuate cross section, contact with the hand is limited primarily to the crest area 27 thereof, thereby minimizing surface contact in general with the interior of the mitten 1.

Upon grasping an article of hot/cold temperature, the exterior nodules 13, formed of a similar arcuate cross section, will engage the article primarily only at the crest portions 15 thereof, thereby making minimal necessary contact with the article and further limiting potential points for heat/cold transfer through the mitten 1. Once again, as heat or cold is transferred through the exterior nodules 13 toward the interior of the mitten 1, it is met with a significant thermal air insulating pocket 33, thereby forcing the heat/cold transfer to be redirected laterally through the body of mitten 1 until it reaches one or more adjacent interior nodules 25, where the heat/cold transfer may continue.

Although it is preferred that nodules 13 and 25 cover substantially the entire exterior and interior surfaces of the mitten, including the wrist area, it is of primary importance that the nodular technology provided herein be incorporated in those palm and finger regions that are most often used for grasping articles of differing or uncomfortable temperatures. Of course, since it is desirable for the protective mitten 1 to accommodate ambidextrous use, it is also preferred that the exterior and interior nodules 13 and 25 cover both opposite sides (3, 3*a*) and (5, 5*a*) thereof.

To be effective, the material used in the manufacture of my protective hand covering should have good heat/cold resistant properties with good elongation and flexibility characteristics. While it is contemplated that one or more polymeric-type materials either alone or in combination may be suitable for such use, the preferred material is silicone (polydimethylsiloxane), which is available in various forms, including Liquid Silicone Rubber (LSR) and High Consistency Rubber (HCR). The preferred range of hardness of the silicone material is 20-50 Shore A; however, a broader range of approximately 5-80 Shore A is also considered suitable for manufacture.

Unlike many prior art devices, my invention is relatively simple in construction and can be readily manufactured as a monolithic one-piece unit utilizing any of the compression, injection, or transfer molding processes that are well-known in the art and commonly used in the manufacture of products formed of polymeric materials. With an appropriate mold that may be readily manufactured by those skilled in the art, my hand protective covering may be mass produced in an effective, low cost manner with minimal required manufacturing procedures.

As an additional option, it is contemplated that the material utilized in the manufacture of my protective hand covering may be chemically enhanced with a thermoluminescent chemical additive that is sensitive to temperature. The chemical additive acts as a thermal sensor or temperature collector within the hand covering to sense and alert the user of potentially dangerous temperatures. Upon sensing an elevated or low temperature exceeding a predetermined threshold, the thermoluminescent chemical will react and cause a distinct change in color of at least the affected portions of the protective hand covering, thereby providing the user thereof with adequate warning that the temperature is closely approaching a dangerous level for handling.

A multiplicity of colors may be used for the above purpose. For instance, the protective covering may be the color blue under 45° C., and change to white once the temperature exceeds 50° C. Alternatively, it could be black under 45° C., and change to either red, white, or yellow once the temperature exceeds 50° C. A number of color combinations and temperature thresholds may be utilized, depending upon the given application or circumstances presented. Although the above discussion focuses primarily on protective hand coverings, it will be appreciated that numerous other applications are contemplated for use of this technology, including without limitation, applications involving or requiring security, safety, environment, health, child care, cosmetics, car accessories, food, detection, road signs, equipment and transportation, clothes, fashion and pharmaceuticals.

My improved protective hand covering is particularly well-suited for use in the food handling industry, as well as for other industrial and residential/household uses requiring protection from uncomfortable and possibly extreme temperatures. With its unique nodular construction, it exhibits excellent anti-slip gripping characteristics, and is highly durable. Moreover, it is environmentally and medically safe, liquid impervious, dishwasher-safe, and heat/freeze resistant from at least −60° C. to 300° C. It is also very supple and comfortable to wear, as well as aesthetically pleasing and capable of manufacture in a plethora of colors. With the ease of manufacturing, this low cost hand covering may be produced with superior thermal protection suitable for use in myriad industrial and household applications.

It will, of course, be understood that various changes may be made in the form, details, arrangement and proportions of the parts without departing from the scope of the invention which comprises the matter shown and described herein and set forth in the appended claims.

The invention claimed is:

1. A protective hand covering, comprising:

(a) a flexible panel member having opposite sides and outer edge portions therearound, each of said opposite sides having a plurality of nodules protruding outwardly therefrom;

(b) at least some of said nodules located on one of said sides of said panel member being of generally small diametrical compass relative to said panel member and disposed inwardly from said edge portions;

(c) at least some of said nodules located on one of said sides of said panel being devoid of any said nodule positioned directly opposite thereto on said opposite side of said panel; and (d) at least one of said sides being adapted for engagement by the hand to facilitate protective handling of foreign objects.

2. The protective hand covering of claim 1, wherein each said nodule on one of said sides of said panel is devoid of any said nodule positioned directly opposite thereto on said opposite side of said panel.

3. The protective hand covering of claim 2, wherein each of said nodules has a central transverse axis extending substantially normal to said side from which it protrudes which is non-aligning relative to said central transverse axis of each of said nodules on said opposite side of said panel.

4. The protective hand covering of claim 1, wherein each of said nodules has a central transverse axis extending substantially normal to said side from which it protrudes, and said axis of at least some of said nodules on one of said sides of said panel is non-aligning relative to said central transverse axis of each of said nodules on said opposite side of said panel.

5. The protective hand covering of claim 1, wherein said panel member is constructed of an polymeric material throughout.

6. The protective hand covering of claim 1, wherein said panel member is constructed primarily of silicone throughout.

7. The protective hand covering of claim 1, wherein said panel member is constructed of a flexible silicone material falling within a range of hardness of approximately 5-80 Shore A.

8. The protective hand covering of claim 1, wherein said panel member is constructed of a flexible silicone material falling within a range of hardness of approximately 20-50 Shore A.

9. The protective hand covering of claim 1, wherein said panel member is constructed of a flexible polymeric material falling within a range of hardness of approximately 5-80 Shore A.

10. The protective hand covering of claim 1, wherein at least one of said sides of said panel member has associated palm and finger engaging regions, and at least said nodules located within said palm and finger engaging regions are devoid of any said nodule positioned directly opposite thereto on said opposite side of said panel.

11. The protective hand covering of claim 1, wherein said nodules are distributed generally evenly and continuously in spaced relation relative to one another over each of said opposite sides of said panel, and are constructed with a generally low-profile arcuate cross-sectional configuration.

12. The protective hand covering of claim 1, wherein said nodules are positioned on said opposite sides of said panel member in relatively uniformly-spaced relation relative to one another, thereby creating a continuous channel around and between said nodules on each of said sides of said panel member.

13. The protective hand covering of claim 1, wherein each of said nodules are substantially semi-spherical in shape and generally uniformly spaced over at least one of said opposite sides of said panel member.

14. The protective hand covering of claim 1, wherein said nodules are integrally-formed with said panel member as a one-piece monolithic unit.

15. The protective hand covering of claim 1, wherein said panel member is constructed of a thermoluminescent polymeric material which reacts to change color upon sensing a change in temperature beyond a predetermined threshold level.

16. The protective hand covering of claim 15, wherein said panel member is constructed of liquid silicone rubber, chemically enhanced with a thermoluminescent chemical additive.

17. The protective hand covering of claim 1, wherein said panel member constitutes a first panel member, said hand covering further comprising:

(d) a second flexible panel member having opposite sides, each of said opposite sides of said second panel member having a plurality of nodules protruding outwardly therefrom, said second panel member overlaying said first panel member and being connected thereto in such manner as to form a hand-receiving pocket therebetween.

18. The protective hand covering of claim 17, wherein said first and second panel members are configured in the general shape of a human hand and peripherally-connected to form a mitten, said mitten having an interior nodular surface and an exterior nodular surface formed by said outwardly protruding nodules on said opposite sides of said first and second panel members.

19. The protective hand covering of claim 18, wherein said mitten is constructed to accommodate ambidextrous use thereof.

20. The protective hand covering of claim 17 or 18, wherein at least some of said nodules located on one of said sides of said second panel member are devoid of any said nodule positioned directly opposite thereto on said opposite side of said second panel member.

21. The protective hand covering of claim 17, wherein said first and second panel members are integrally-formed together as a one-piece unit.

22. A protective hand covering, comprising:

(a) a mitten constructed of a flexible polymeric material throughout, said mitten having an interior surface defining an interior hand-receiving pocket with an opening thereto, and an opposing exterior surface defining a forehand and backhand side of said mitten;

(b) a plurality of spaced interior nodules integrally-formed with said interior surface and protruding outwardly therefrom toward said interior pocket of said mitten, each of said interior nodules having a central transverse axis extending substantially normal to said interior surface at such point where it is formed;

(c) a plurality of spaced exterior nodules integrally-formed with said exterior surface and protruding outwardly therefrom away from said mitten, each of said exterior nodules having a central transverse axis extending substantially normal to said exterior surface at such point where it is formed; and (d) at least some of said interior nodules and said exterior nodules being disposed on the same said forehand side of said mitten and being so arranged on said mitten such that said central axis of at least some of said interior nodules on said forehand side of said mitten are non-aligning relative to said central axis of any of said exterior nodules on said forehand side of said mitten.

23. The protective hand covering of claim 22, wherein at least some of said interior nodules and said exterior nodules being disposed on the same said backhand side of said mitten and being so arranged on said mitten such that said central axis of at least some of said interior nodules on said backhand side of said mitten are non-aligning relative to said central axis of any of said exterior nodules on said backhand side of said mitten.

24. The protective hand covering of claim 22, wherein said mitten is constructed generally symmetrical about a plane extending between said forehand and backhand sides of said mitten and generally parallel thereto.

25. The protective hand covering of claim 22, wherein said mitten is constructed for ambidextrous use.

26. The protective hand covering of claim 22, wherein said central axis of said interior nodules on said forehand side of said mitten are non-aligning relative to said central axis of any of said exterior nodules on said forehand side of said mitten and said central axis of said interior nodules on said backhand side of said mitten are non-aligning relative to said central axis of any of said exterior nodules on said backhand side of said mitten, to thereby facilitate ambidextrous use of said mitten.

27. The protective hand covering of claim 22, wherein said central axis of said interior nodules of said mitten are non-aligning relative to said central axis of any of said exterior nodules of said mitten.

28. The protective hand covering of claim 22, wherein said mitten is constructed primarily of silicone throughout.

29. The protective hand covering of claim 28, wherein said silicone has a material hardness falling in the range of approximately 5-80 Shore A.

30. The protective hand covering of claim 28, wherein said silicone has a material hardness falling in the range of approximately 20-50 Shore A.

31. The protective hand covering of claim 22, wherein said interior and exterior nodules are formed on said mitten in generally evenly and continuously spaced relation relative to one another.

32. The protective hand covering of claim 22, wherein said interior and exterior nodules are constructed with a generally low-profile arcuate cross-sectional configuration.

33. The protective hand covering of claim 22, wherein said interior nodules are relatively uniformly spaced on said interior surface so as to define a continuous channel around and between said interior nodules which facilitates movement of air therethrough.

34. The protective hand covering of claim 33, wherein said exterior nodules are relatively uniformly spaced on said exterior surface so as to define a continuous channel around and between said exterior nodules which facilitates movement of air therethrough.

35. The protective hand covering of claim 22, wherein at least a portion of said mitten is constructed of a thermoluminescent polymeric material which reacts to change color upon sensing a change in temperature beyond a predetermined threshold level.

36. The protective hand covering of claim 22, wherein said mitten is constructed of liquid silicone rubber, chemically enhanced with a thermoluminescent chemical additive.

37. A protective hand covering, comprising:

(a) a flexible panel member having opposite sides, each of said opposite sides having a plurality of nodules protruding outwardly therefrom;

(b) each of said nodules located on one of said sides of said panel being devoid of any said nodule positioned directly opposite thereto on said opposite side of said panel; and (c) at least one of said sides being adapted for engagement by the hand to facilitate protective handling of foreign objects.

38. A protective hand covering, comprising:

(a) a flexible panel member having opposite sides, each of said opposite sides having a plurality of nodules protruding outwardly therefrom;

(b) at least some of said nodules located on one of said sides of said panel being devoid of any said nodule positioned directly opposite thereto on said opposite side of said panel;

(c) wherein each of said nodules has a central transverse axis extending substantially normal to said side from which it protrudes, and said axis of at least some of said nodules on one of said sides of said panel is non-aligning relative to said central transverse axis of each of said nodules on said opposite side of said panel; and (d) at least one of said sides being adapted for engagement by the hand to facilitate protective handling of foreign objects.

39. A protective hand covering, comprising:

(a) a flexible panel member having opposite sides and an outer edge, each of said opposite sides having a plurality of nodules protruding outwardly therefrom;

(b) at least some of said nodules located on one of said sides of said panel being devoid of any said nodule positioned directly opposite thereto on said opposite side of said panel;

(c) at least some of said nodules on one of said sides of said panel being constructed and arranged such that the entire outer confines thereof are disposed inwardly from said edge of said panel, thereby forming an air passageway extending between and around said nodules within the outer confines of said panel; and (d) at least one of said sides being adapted for engagement by the hand to facilitate protective handling of foreign objects.

* * * * *